US009556828B2

(12) United States Patent
Weigl

(10) Patent No.: US 9,556,828 B2
(45) Date of Patent: Jan. 31, 2017

(54) METHOD AND APPARATUS FOR OPERATING A TANK VENTILATION SYSTEM

(75) Inventor: Manfred Weigl, Sinzing/Viehhausen (DE)

(73) Assignee: Continental Automotive GmbH, Hannover (DE)

( * ) Notice: Subject to any disclaimer, the term of this patent is extended or adjusted under 35 U.S.C. 154(b) by 177 days.

(21) Appl. No.: 13/879,585

(22) PCT Filed: Oct. 12, 2011

(86) PCT No.: PCT/EP2011/067832

§ 371 (c)(1),
(2), (4) Date: Apr. 15, 2013

(87) PCT Pub. No.: WO2012/049219

PCT Pub. Date: Apr. 19, 2012

(65) Prior Publication Data

US 2013/0213366 A1 Aug. 22, 2013

(30) Foreign Application Priority Data

Oct. 14, 2010 (DE) ..... 10 2010 048 313

(51) Int. Cl.

| | |
|---|---|
| ***F02M 25/08*** | (2006.01) |
| ***F02D 41/00*** | (2006.01) |
| ***F02D 29/02*** | (2006.01) |

(52) U.S. Cl.

CPC ..... *F02M 25/0836* (2013.01); *F02D 29/02* (2013.01); *F02M 25/089* (2013.01); *F02D 41/0042* (2013.01); *F02D 41/0045* (2013.01)

(58) Field of Classification Search

CPC ..... F02M 25/089; F02M 25/0872; F02M 25/0836; F02M 25/0827; F02M 25/0809; F02M 25/0854; F02M 33/04; F02D 41/004; F02D 41/003; F02D 41/0045; F02D 41/0042; F02D 29/02

See application file for complete search history.

(56) References Cited

U.S. PATENT DOCUMENTS

| | | | |
|---|---|---|---|
| 5,373,822 | A | 12/1994 | Thompson |
| 5,377,644 | A | 1/1995 | Krohm |

(Continued)

FOREIGN PATENT DOCUMENTS

| | | |
|---|---|---|
| CN | 2036271 | 4/1989 |
| CN | 1181809 | 5/1998 |

(Continued)

*Primary Examiner* — Lindsay Low
*Assistant Examiner* — George Jin
(74) *Attorney, Agent, or Firm* — Cozen O'Connor

(57) ABSTRACT

The tank ventilation system has an adsorption vessel, a regeneration duct and a pump. The adsorption vessel captures and temporarily stores fuel vapors emerging from a fuel tank. A purge air flow can flow through the adsorption vessel. The regeneration duct connects the adsorption vessel to an intake duct. In the regeneration duct there is arranged a pump designed to draw the purge air out of the adsorption vessel and admix the purge air to intake air in the intake duct. A density of the purge air that flows in the regeneration duct is determined. Furthermore, a purge air mass flow flowing in the regeneration duct is determined as a function of the density of the purge air and a predefined pump characteristic of the pump.

8 Claims, 1 Drawing Sheet

(56) References Cited

U.S. PATENT DOCUMENTS

| | | | | |
|---|---|---|---|---|
| 5,881,700 | A | 3/1999 | Gras et al. | |
| 5,918,580 | A | 7/1999 | Daimler-Benz | |
| 6,036,456 | A | 3/2000 | Peters et al. | |
| 6,659,087 | B1 * | 12/2003 | Reddy | F02D 41/0045 123/357 |
| 7,647,920 | B2 * | 1/2010 | Amano et al. | 123/519 |
| 2002/0162457 | A1 * | 11/2002 | Hyodo | F02M 25/089 96/109 |
| 2003/0000505 | A1 * | 1/2003 | Auernhammer | F02M 25/0836 123/520 |
| 2004/0149016 | A1 * | 8/2004 | Kano | F02M 25/0818 73/40 |
| 2005/0211228 | A1 | 9/2005 | Amano et al. | |
| 2006/0042605 | A1 * | 3/2006 | Amano | F02M 25/0809 123/520 |
| 2006/0144373 | A1 * | 7/2006 | Kano | F02D 41/0045 123/519 |
| 2006/0225713 | A1 * | 10/2006 | Kano | F02D 41/0032 123/520 |
| 2006/0283427 | A1 * | 12/2006 | Koyama | F02D 41/0042 123/519 |
| 2007/0089721 | A1 * | 4/2007 | Amano | F02D 41/0045 123/698 |
| 2007/0137622 | A1 * | 6/2007 | Koyama | F02D 41/0045 123/520 |
| 2007/0175455 | A1 | 8/2007 | Amano et al. | |
| 2008/0179121 | A1 | 7/2008 | Sauvlet et al. | |
| 2008/0314369 | A1 * | 12/2008 | Takakura | F02M 25/0827 123/520 |
| 2009/0031996 | A1 | 2/2009 | Chung | |
| 2011/0132331 | A1 * | 6/2011 | Pursifull | 123/478 |
| 2011/0300787 | A1 * | 12/2011 | Bierl | B60K 15/03504 454/141 |

FOREIGN PATENT DOCUMENTS

| | | | |
|---|---|---|---|
| CN | 1438473 | | 8/2003 |
| CN | 101224745 | | 7/2008 |
| CN | 101323250 | | 12/2008 |
| CN | 101440757 | | 5/2009 |
| DE | 43 16 392 | A1 | 12/1993 |
| DE | 43 163 92 | A1 | 12/1993 |
| DE | 196 17 386 | C1 | 7/1997 |
| DE | 196 39 116 | A1 | 3/1998 |
| DE | 196 45 382 | A1 | 5/1998 |
| DE | 197 40 582 | | 3/1999 |
| DE | 197 40 582 | A1 | 3/1999 |
| DE | 100 60 350 | A1 | 6/2002 |
| DE | 10 2006 000 166 | A1 | 11/2006 |
| DE | 10 2007 002 188 | A1 | 7/2008 |
| DE | 10 2007 002188 | | 7/2008 |
| EP | 0 604 027 | A1 | 6/1994 |

* cited by examiner

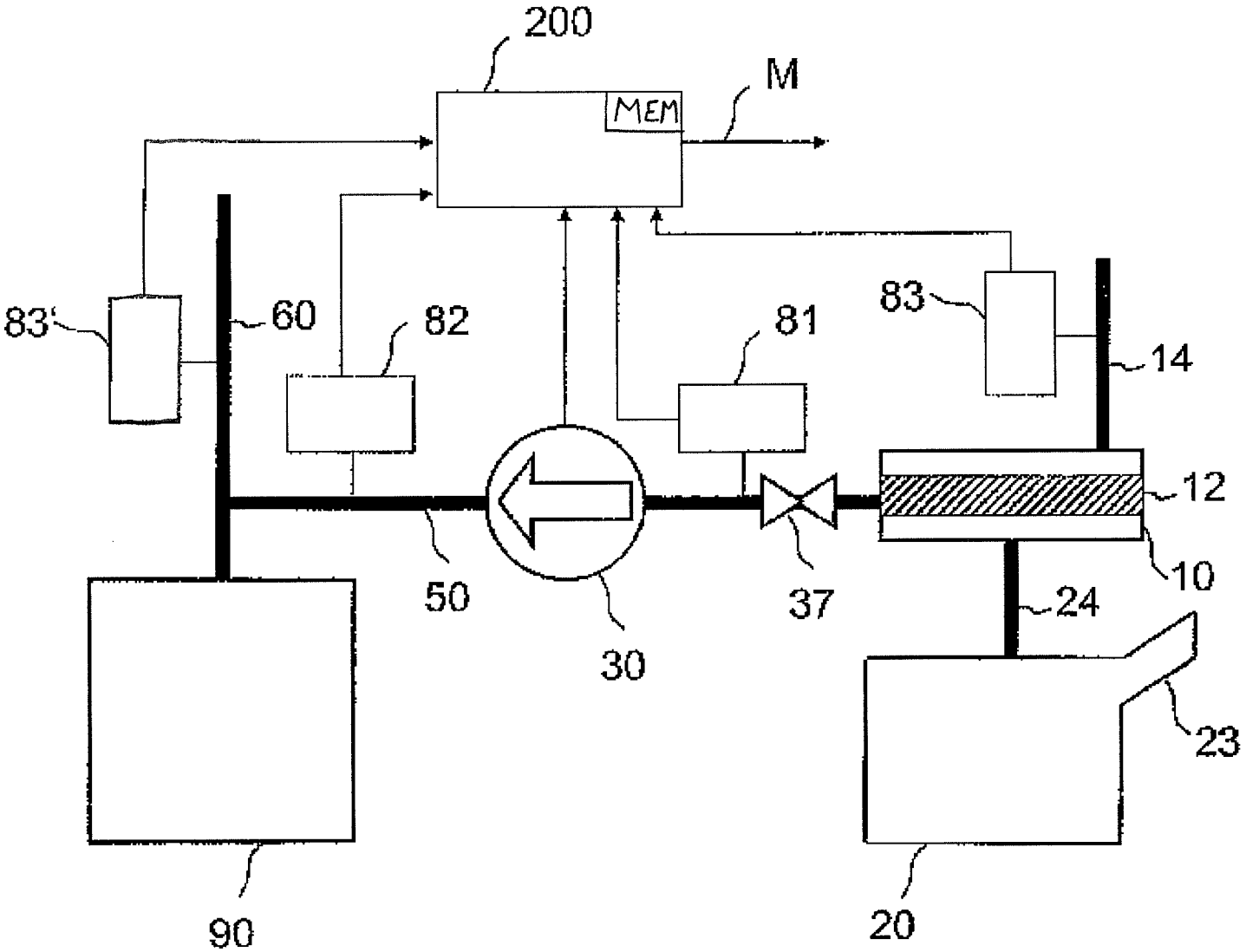
200
MEM
M
83
14
12
10
23
24
20
81
37
30
82
50
60
90
83'

METHOD AND APPARATUS FOR OPERATING A TANK VENTILATION SYSTEM

CROSS REFERENCE TO RELATED APPLICATION

This is a U.S. national stage of application No. PCT/EP2011/067832, filed on 12 Oct. 2011. Priority is claimed on German Application No. 10 2010 048 313.3 filed 14 Oct. 2010, the content of which is incorporated here by reference.

BACKGROUND OF THE INVENTION

1. Field of the Invention

The invention relates to a method and a device for operating a tank ventilation system, and to a tank ventilation system.

2. Description of Prior Art

It is known to equip vehicles, in particular motor vehicles, with tank ventilation systems to avoid evaporation of hydrocarbons from the fuel tank into the atmosphere. In order to adsorb the hydrocarbon vapors, the tank ventilation systems are frequently equipped with an activated carbon filter. Such activated carbon filters can only absorb a limited quantity of hydrocarbons and have to be regenerated, that is to say cleaned, when a certain degree of saturation is reached. The activated carbon filter can therefore serve as a buffer for the hydrocarbons released from the fuel, as a result of which the hydrocarbons released from the fuel can be fed in a predefined fashion for combustion in an internal combustion engine.

DE 10 2007 002 188 A1 discloses a tank ventilation system for a hybrid vehicle, wherein the tank ventilation system comprises at least a fuel tank and a suction line leading from a regeneratable filter device to an intake section of the internal combustion engine. A control device is provided that can actuate various valve devices to purge the filter device, with the result that ambient air can be fed to the internal combustion engine through the filter device and the suction line. The control device is also embodied in such a way that in a pure electric operating mode of the hybrid vehicle it activates the internal combustion engine as a function of a load state of the filter device or purge gas concentration.

US 2005/0211228 A1 discloses a fuel vapor treatment system for an internal combustion engine. A pump generates a gas flow within a measuring passage that has a throttle orifice. A difference pressure sensor detects a pressure difference between the two ends of the throttle orifice. Switching valves are arranged in the measuring passage to generate a first concentration measuring state in which the measuring passage is opened at its two ends and in which the gas flowing through the measuring passage is the atmosphere, and to generate a second concentration measuring state in which the measuring passage is connected at its two ends to a container and in which the gas flowing through the measuring passage is a fuel vapor which is an air/fuel mixture provided by the container. An ECU calculates a fuel vapor concentration on the basis of a pressure difference detected in the first concentration measuring state and a pressure difference detected in the second concentration measuring state.

SUMMARY OF THE INVENTION

An object on which the invention is based is to provide a method and a corresponding device for operating a tank ventilation system, and a tank ventilation system, which permit flexible ventilation of the tank and simplify a desired fuel injection.

One embodiment of the invention is a method and a corresponding device for operating a tank ventilation system having an adsorption container, a regeneration duct and a pump. The adsorption container captures and buffers fuel vapors emerging from a fuel tank. A purge airflow can flow through the adsorption container. The regeneration duct connects the adsorption container to an intake duct. The pump is arranged in the regeneration duct and is designed to draw the purge air out of the adsorption container and add it to intake air in the intake duct. A density of the purge air that flows in the regeneration duct is ascertained. Furthermore, a purge air mass flow, which flows in the regeneration duct, is ascertained as a function of the density of the purge air and a predefined pumping characteristic of the pump.

This makes it possible to determine the purge air mass flow with a high degree of accuracy even at high purge rates with a high hydrocarbon concentration. This can advantageously make a contribution to making pilot control of a lambda controller and/or control for metering fuels sufficiently precise and/or to keep control fluctuations during the metering of fuel small. The pump in the regeneration duct between the adsorption container and the intake duct makes it possible to carry out purging of the adsorption container independently of an underpressure prevailing in an intake manifold of the internal combustion engine. In this way, purging of the adsorption container which is independent of an operating range of the internal combustion engine can take place.

In one embodiment, the density of the purge air which flows in the regeneration duct is ascertained as a function of a detected hydrocarbon concentration of the purge air and/or a temperature of the intake air and/or a temperature of ambient air flowing into the adsorption container, and/or of a detected pressure difference in the regeneration duct. In this context, the pressure difference represents a difference between a first pressure downstream of the pump and a second pressure upstream of the pump. The temperature or temperatures and the pressure difference can advantageously be detected with sensor elements, which are already present in contemporary systems, permitting a cost-effective implementation. Sensor elements for measuring the hydrocarbon concentration can also be used in systems.

In one embodiment, a rotational speed of the pump is detected, and the purge air mass flow is ascertained as a function of the rotational speed of the pump.

In one embodiment, the pump is embodied such that a volume throughput rate of the pump is proportional to a rotational speed of the pump.

In one embodiment, the pump is a radial pump. This permits a cost-effective implementation of a tank ventilation system since a radial pump can be embodied cost-effectively compared to other types of pump with a comparable performance capability. Open-loop or closed-loop control of a radial pump can be embodied in a simple way since changing the pump rotational speed changes both the volume throughput rate and the pressure, and therefore the power consumption.

In one embodiment, the pump is a vane cell pump. Relatively high pressure differences can be generated with a vane cell pump.

In one embodiment a controller of the pump and/or of a purging air valve, which is arranged in the regeneration duct, is controlled as a function of the ascertained purge air mass flow and/or of the detected hydrocarbon concentration.

One embodiment of the invention is a method and a device for operating a tank ventilation system with an adsorption container, a regeneration duct, and a pump. The adsorption container serves to capture and buffer fuel vapors emerging from a fuel tank. Air can pass into the adsorption container via an air duct, and a purge airflow can flow through the adsorption container. The regeneration duct connects the adsorption container to an intake duct. The pump is arranged in the air duct and is designed to blow the purge air out of the adsorption container and to add it to intake air in the intake duct. A density of the purge air, which flows in the regeneration duct, is ascertained. Furthermore, a purge air mass flow, which flows in the regeneration duct, is ascertained as a function of the density of the purge air and a predefined pump characteristic of the pump.

The above embodiments relate to each other. The density of the purge air, which flows in the regeneration duct, is ascertained as a function of a difference between a first pressure in the intake duct and a second pressure in the air duct, which is detected upstream of the pump.

In one embodiment of the invention a tank ventilation system for an internal combustion engine. The tank ventilation system has an adsorption container for capturing and buffering fuel vapors emerging from a fuel tank. A purge airflow flows through the adsorption container. Furthermore, the tank ventilation system has a regeneration duct that connects the adsorption container to an intake duct. In addition, the tank ventilation system has a pump, which is arranged in the regeneration duct, designed to draw the purge air out of the adsorption container and add it to intake air in the intake duct.

In one embodiment, the tank ventilation system has a controllable purge air valve arranged in the regeneration duct whose degree of opening for the purging of the adsorption container can be adjusted.

In one embodiment, the tank ventilation system has at least a first sensor element designed to detect a hydrocarbon concentration of the purge air in the regeneration duct.

In one embodiment, the tank ventilation system has at least a second sensor element designed to detect a temperature of the purge air in the regeneration duct.

In one embodiment, the tank ventilation system has a third sensor element designed to detect a pressure in the intake duct and/or in an air duct via which ambient air can flow into the adsorption container.

BRIEF DESCRIPTION OF THE DRAWINGS

Exemplary embodiments of the invention are explained in more detail below with reference to the schematic drawing, in which:

FIG. 1 is an arrangement having a tank ventilation system and a device 200 for operating the tank ventilation system.

Elements with the same design or function are provided with the same reference symbols in all the figures.

DETAILED DESCRIPTION OF THE PREFERRED EMBODIMENTS

The arrangement shown in FIG. 1 has a tank ventilation system, a device 200 for operating the tank ventilation system, an internal combustion engine 90 with an intake section, and a fuel tank 20. The arrangement shown can be arranged, for example, in a motor vehicle.

The fuel tank 20 has a filler connector 23 for filling fuel tank 20. Fuel is stored in the fuel tank 20. The fuel tank 20 also has a tank ventilation duct 24.

The tank ventilation system has, for example, an adsorption container 10, a purge air valve 37, a pump 30 and a regeneration duct 50.

The adsorption container 10 is arranged downstream of the tank ventilation duct 24. Hydrocarbons, which evaporate through heating of the fuel, are conducted into the adsorption container 10 via the tank ventilation duct 24. The adsorption container 10 comprises, for example, an activated carbon filter 12 for temporarily storing the hydrocarbons outgassing from the fuel tank 20. Activated carbon filter 12 can buffer only a limited quantity of hydrocarbons. The activated carbon filter must therefore be regenerated, that is to say the hydrocarbons absorbed in it must be removed. The adsorption container 10 therefore has, for example, an air duct 14 in which air can flow from the surroundings into the adsorption container 10.

A controllable valve can be arranged both in the air duct 14 and in the tank ventilation duct 24, respectively.

The adsorption container 10 is connected by the regeneration duct 50 to the intake duct 60, which is part of an intake section of the internal combustion engine 90. The purge air valve 37 is arranged in the regeneration duct 50. For example, purging of the adsorption container 10 can be controlled by actuating the purge air valve 37 by a suitably embodied control device. For example, a degree of opening of the purge air valve 37 for purging the adsorption container 10 may be adjustable as a function of a predefined operating range of the internal combustion engine 90, and/or of a predefined degree of loading of the adsorption container 10, and/or of the hydrocarbon concentration of the purge air in the regeneration duct 50.

Since an underpressure generated by an intake manifold of the internal combustion engine 90 is not sufficient in various operating ranges of the internal combustion engine 90 to bring about purging of the adsorption container 10 when the purge air valve 37 is opened, a pressure generating device, for example a pump 30, is arranged in the regeneration duct 50. The pump 30 is designed to generate a pressure difference in the regeneration duct 50 so that air can be drawn out of the surroundings via the air duct 14. The air flows through the activated carbon filter 12, and the activated carbon filter 12 can be cleaned. The purge air, which is enriched with fuel vapor, is added to intake air, which flows in the intake duct 60, and can therefore be fed to combustion in the internal combustion engine 90. This makes it possible for purging of the activated carbon filter 12 to take place independently of various operating ranges of the internal combustion engine 90, and as a result sufficient time is available for the purging of the activated carbon filter 12 even in motor vehicles with, for example, an automatic start/stop system, and/or partial load control by means of variable valve control, and/or in hybrid systems, without an internal combustion engine behavior and/or a driving behavior of the motor vehicle being influenced. The pump 30 can be arranged, for example, in the engine cavity. The purge air valve 37 can be arranged downstream of the absorption container 10 both before and after the pump 30 in the regeneration duct 50.

The tank ventilation system can have, for example, various sensor elements 81, 82, 83, 83', which are designed to detect various state variables. The respective detected state variables can be evaluated, for example, by the device 200 for operating the tank ventilation system such that a density of the purge air that flows in the regeneration duct 50 can be ascertained. For example, the tank ventilation system can have at least a first sensor element 81 designed to detect a hydrocarbon concentration of the purge air in the regeneration duct 50. The first sensor element 81 for detecting the hydrocarbon concentration can be arranged, for example, in the regeneration duct 50. Arrangement is possible both in the vicinity of the engine 90 and in the vicinity of the tank 20. Furthermore, the tank ventilation system can have at least a second sensor element 82 designed to detect a temperature of the purge air in the regeneration duct 50. In addition, the tank ventilation system can have, for example, a third sensor element 83' designed to detect a pressure in the intake duct 60 and/or a fourth sensor element 83 in the air duct 14 via which ambient air can flow into the adsorption container 10. An ambient pressure can be detected with the fourth sensor element 83 arranged, for example, in the air duct 14. The ambient pressure can additionally or alternatively also be detected, for example, by a pressure sensor element arranged in an engine control unit.

For example a purge air mass flow (M) can be determined as a function of a pump characteristic of the pump 30 and of the determined density. The pump 30 is advantageously embodied in such that the volume throughput rate of the pump 30 is proportional to a rotational speed of the pump 30. The purge air mass flow (M) can in this case be determined, for example, as a function of the product of the density and a volume flow in the regeneration duct 50, wherein a first derivative over time of the volume throughput rate of the pump represents the volume flow. The pump 30 can be embodied, for example, as a radial pump or as vane cell pump. The radial pump or vane cell pump can be driven, for example, with a brushless electric motor. As a result, it is possible, for example, to detect the rotational speed and/or power consumption of the pump 30, by the device 200 for operating the tank ventilation system.

The ascertained purge air mass flow (M) can be utilized, for example, for a pilot control of a lambda controller and/or for controlling metering of fuel. The density and the purge air mass flow (M) are determined, for example, by a program which is stored in a memory MEM and which is executed by a control unit. The control unit can also be referred to as a device 200 for operating the tank ventilation system.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A method for operating a tank ventilating system having an adsorption container configured to capture and buffer fuel vapors from a fuel tank, wherein a purge airflow flows through the adsorption container, a regeneration duct that connects the adsorption container to an intake duct, and a pump arranged in the regeneration duct configured to draw purge air out of the adsorption container and add it to intake air in the intake duct, the method comprising:

receiving, by a controller, an input from at least one sensor;

determining by the controller a density of the purge air that flows in the regeneration duct with based at least in part on the input from the at least one sensor;

determining by the controller a purge air mass flow that flows in the regeneration duct based at least in part on the density of the purge air determined based at least in part on the input from the at least one sensor and a predefined pump characteristic of the pump, wherein the predefined pump characteristic of the pump comprises a volume throughput rate of the pump being proportional to a rotational speed of the pump; and controlling, by the controller, the pump and a purge air valve arranged in the regeneration duct based at least in part on at least one of a determined purge air mass flow and the detected hydrocarbon concentration.

2. The method as claimed in claim 1, wherein the density of the purge air that flows in the regeneration duct is determined as a function of at least one of:

a detected hydrocarbon concentration of the purge air, a temperature of the intake air, a temperature of ambient air that flows into the adsorption container, and a detected pressure difference in the regeneration duct.

3. The method as claimed in claim 1, further comprising detecting a rotational speed of the pump, wherein the purge air mass flow is determined based at least in part on the rotational speed of the pump.

4. The method as claimed in claim 3, wherein the pump is a radial pump.

5. The method as claimed in claim 3, wherein the pump is a vane cell pump.

6. A device for operating a tank ventilating system, comprising an adsorption container configured to capture and buffer fuel vapors from a fuel tank, wherein a purge airflow can flow through the adsorption container;

a regeneration duct arranged to connect the adsorption container to an intake duct; and a pump arranged in the regeneration duct configured to draw purge air out of the adsorption container and add it to intake air in the intake duct, wherein the device is configured to:

receive an input from at least one sensor;

determine a density of the purge air that flows in the regeneration duct by the at least one sensor, determine a purge air mass flow that flows in the regeneration duct based at least in part on the density of the purge air determined based at least in part on the input from the at least one sensor and a predefined pump characteristic of the pump, wherein the predefined pump characteristic of the pump comprises a volume throughput rate of the pump being proportional to a rotational speed of the pump; and control the pump and a purge air valve arranged in the regeneration duct based at least in part on at least one of a determined purge air mass flow and the detected hydrocarbon concentration.

7. A method for operating a tank ventilating system, having an adsorption container configured to capture and buffer fuel vapors from a fuel tank, wherein air can pass into the adsorption container via an air duct, and a purge airflow can flow through the adsorption container, a regeneration duct that connects the adsorption container to an intake duct, and a pump arranged in the air duct configured to blow purge air out of the adsorption container and to add it to intake air in the intake duct, the method comprising:

receiving, by a controller, an input from at least one sensor;

determining, by the controller, a density of the purge air that flows in the regeneration duct with based at least in part on the input from the at least one sensor;

determining, by the controller, a purge air mass flow that flows in the regeneration duct based at least in part on the density of the purge air determined based at least in part on the input from the at least one sensor and a predefined pump characteristic of the pump, wherein the predefined pump characteristic of the pump comprises a volume throughput rate of the pump being proportional to a rotational speed of the pump; and controlling, by the controller, the pump and a purge air valve arranged in the regeneration duct based at least in part on at least one of a determined purge air mass flow and the detected hydrocarbon concentration.

8. The method as claimed in claim 1, wherein the purge air mass flow is determined as a function of a product of the density of the purge air that flows in the regeneration duct and a volume flow of the purge air that flows in the regeneration duct, wherein a first derivative over time of the volume throughput rate of the pump represents the volume flow.

* * * * *